US006871448B1

(12) United States Patent
Kline

(10) Patent No.: US 6,871,448 B1
(45) Date of Patent: Mar. 29, 2005

(54) APPARATUS MOVING WITH A SLIDING DOOR TO PROVIDE AN UNOBSTRUCTED PASSAGEWAY AND TO SEAL A NOTCH WITHIN A WATERTIGHT BARRIER

(76) Inventor: C. Walter Kline, 2763 SW. 6th St., Delray Beach, FL (US) 33445

( * ) Notice: Subject to any disclaimer, the term of this patent is extended or adjusted under 35 U.S.C. 154(b) by 0 days.

(21) Appl. No.: 10/689,350

(22) Filed: Oct. 20, 2003

(51) Int. Cl.[7] ..... E06B 7/28; E06B 1/70
(52) U.S. Cl. ..... 49/319; 49/321; 49/469
(58) Field of Search ..... 49/316, 319, 311, 49/303, 310, 321, 469, 470, 404, 406, 408, 209, 208, 407, 476.1; 52/207, 204.51, 209, 656.4, 656.7

(56) References Cited

U.S. PATENT DOCUMENTS

| | | | | | |
|---|---|---|---|---|---|
| 1,494,329 | A | * | 5/1924 | Austin | 49/310 |
| 2,248,719 | A | * | 7/1941 | Owen | 49/303 |
| 4,089,136 | A | * | 5/1978 | Lapinski et al. | 49/308 |
| 4,237,664 | A | | 12/1980 | Wilmes | |
| 4,406,088 | A | * | 9/1983 | Berndt, Jr. | 49/309 |
| 4,432,164 | A | * | 2/1984 | Baguet | 49/209 |
| 4,437,266 | A | * | 3/1984 | Keller | 49/406 |
| 4,692,961 | A | | 9/1987 | Brown | |
| 4,703,586 | A | * | 11/1987 | Smith et al. | 49/307 |
| 4,805,345 | A | * | 2/1989 | Ohi | 49/308 |
| 5,560,164 | A | | 10/1996 | Ahrens | |
| 5,642,588 | A | * | 7/1997 | Sowers | 49/307 |
| 5,870,859 | A | | 2/1999 | Kitada | |
| 5,887,387 | A | * | 3/1999 | Dallaire | 49/408 |
| 6,017,105 | A | * | 1/2000 | Goughnour et al. | 49/209 |
| 6,082,047 | A | * | 7/2000 | Comaglio et al. | 49/308 |
| 6,125,584 | A | * | 10/2000 | Sanders | 49/312 |
| 6,170,207 | B1 | * | 1/2001 | Saindon | 52/204.2 |
| 6,195,939 | B1 | * | 3/2001 | Sowers | 49/310 |

FOREIGN PATENT DOCUMENTS

JP 11182154 A 7/1999

* cited by examiner

*Primary Examiner*—Hugh B. Thompson, II
(74) *Attorney, Agent, or Firm*—Malloy & Malloy, P.A.

(57) ABSTRACT

A sliding door assembly includes a barrier plate extending across the lower portion of the doorway to prevent the intrusion of water during severe weather conditions. A notch within the barrier plate, enlarging the passageway opened by the sliding door to form an obstruction-free passageway, is sealed by compressing a gasket between the barrier plate and a compression plate mounted to move with the sliding door. An actuator, mounted along the floor adjacent the compression plate with the sliding door closed, moves the compression plate toward the barrier plate, compressing the gasket, in response to operation of a latch lever.

22 Claims, 7 Drawing Sheets

APPARATUS MOVING WITH A SLIDING DOOR TO PROVIDE AN UNOBSTRUCTED PASSAGEWAY AND TO SEAL A NOTCH WITHIN A WATERTIGHT BARRIER

BACKGROUND OF THE INVENTION

1. Field of the Invention

This invention relates to providing an unobstructed passageway through a sliding door and additionally to providing a barrier to prevent water infiltration through the door opening.

2. Summary of the Background Art

In many areas prone to high velocity winds and rain, a watertight barrier is provided to prevent water intrusion into a building. For example, the threshold frame member forming the lower portion of the frame structure extending around a sliding door is provided inside the door with a leg extending upward from the floor to a height required to accommodate a particular water level or design pressure. The problem with this approach is that the barrier presents a tripping hazard to people walking through the open doorway, and a serious obstacle to anyone trying to roll a wheelchair or wheeled cart through the door opening. There are numerous instances of conflict between building codes requiring such barriers to prevent damages from water penetration and federal regulations covering ADA (Americans with Disabilities Act) Standards for Accessible design.

In some locations, these problems can be alleviated by building ramps extending downward from the top of the obstruction to the surfaces inside and outside the building. However, when such ramps are built at the degree of slope mandated for wheelchair usage, they are often too long to be used with narrow walkways, balconies or patios outside or with small rooms inside. Therefore, what is needed is a mechanism for sealing against water intrusion that moves out of the way, as a sliding door is opened.

Sliding doors of vehicles, such as vans, and of many railroad freight cars, are provided with airtight sealing mechanisms that are additionally watertight at least under rain conditions, with the door being mounted on cranks that allow it to move inward into the mating opening and outward therefrom. The sealing process occurs as the door is moved inward, and the seals are broken as the door is moved outward. While the door is held outward by the cranks, it is slid along the outside of the wall of the vehicle or railroad car. What is needed is a way for providing a watertight opening at a sliding door within a building where weather conditions include high winds and rain, without requiring a different type of door movement and without significantly changing the appearance of the building when the door is open.

U.S. Pat. No. 5,870,859 describes a watertight sliding door structure including a movable door, a stationary door, which is made watertight without increasing the height of a portion of the sill. The movable door and the stationary door are each provided with a stile extending vertically along the central edge of the door. As the movable door is closed, these stiles meet one another, with the gap between them being sealed by elastomeric strips. Horizontally extending sealing strips are also provided along the upper and lower frame members of the doors. A pressure-equalized clearance area is formed between the sill of the window frame of the movable door and the stationary door and attachments provided on the sill. Additionally, an airtight member is provided to divide the pressure-equalized clearance area into and an inside clearance area of the single movable door. By forming the pressure-equalized clearance area between the inside clearance area and the outside clearance area of the single movable door in the sill partition, a difference in the pressure between the sill portion and the outside is not produced, so that rain water is exhausted by a dead load. What is needed is a method for sealing a sliding door assembly without requiring that a movable door to be slid open and shut with elongated sealing members in sliding contact with opposing surfaces.

Japanese Patent Application 11182154A describes a water barrier plate that moves vertically with the movement of a flexible door extending around the walls of a stall within a bathroom. The door is opened by moving the flexible door so that a space between its opposite ends is aligned with an opening in the walls, with pins at these opposite ends moving the water barrier plate downward into a slot within the threshold as the door is fully opened. The door is closed by moving the flexible door so that the space between these opposite ends is aligned within the walls, with these pins moving the water barrier plate upward within the slot. What is needed is a water barrier that can be moved out of the way without causing the barrier to retract into a slot extending downward within the floor, so that there is no need to weaken the floor structure with such a slot, and so that the apparatus can be readily installed in an existing building. Additionally, what is needed is an apparatus operable with a conventional sliding door, in which the entire door moves to one side of a passageway as it is opened.

U.S. Pat. Nos. 4,692,961 and 5,560,164 describe water-shielding structures for removable placement in openings of buildings. What is needed is a structure that can be left attached within a doorway without impeding traffic through the passageway.

A number of patents, such as U.S. Pat. No. 4,237,664, describe door sill structures including surfaces of different elevations to prevent water intrusion without addressing the difficulties in access by foot or wheelchair that may be caused by such changes in elevation.

SUMMARY OF THE INVENTION

According to a first aspect of the invention, apparatus is provided for sealing a notch within a barrier plate extending across a lower portion of an opening covered by a sliding door movable between open and closed positions. The apparatus includes a compression panel, a carrier bracket, a compressible gasket, and an actuator. The carrier bracket is attached to the sliding door. The compression panel is mounted within the carrier bracket to be movable toward the barrier plate and away from the barrier plate. The compressible gasket is disposed between the compression panel and the barrier plate to extend adjacent the notch with the sliding door in the closed position. The actuator is disposed adjacent the compression panel with the sliding door in the closed position. The actuator is mounted to move along a stationary surface between a disengaged and an engaged position. Movement of the actuator into the engaged position with the sliding door in the closed position causes the compression panel to be moved in contact with the actuator toward the barrier plate, compressing the compressible gasket between the compression panel and the barrier plate. Movement of the actuator into the disengaged position with the sliding door in the closed position allows movement of the compression panel in contact with the actuator away from the barrier plate, releasing compression of the compressible gasket between the compression panel and the barrier plate.

According to another aspect of the invention, this apparatus additionally includes a sliding door and a frame mounting the sliding door to move between open and closed positions, with the frame including a barrier plate having a notch forming a part of a passageway covered by the sliding door in its closed position.

For example, the actuator includes an elongated member extending adjacent the component panel with the sliding door in the closed position, with the apparatus additionally including stationary ramps disposed adjacent opposite ends of the stationary member. The actuator then moves along the stationary ramps between the disengaged position and the engaged position, with the stationary ramps being inclined to move the actuator toward the barrier plate in contact with the compression panel with the sliding door in the closed position as the actuator is moved into the engaged position.

According to yet another aspect of the invention, a method is provided for retrofitting a passageway enclosed by a door sliding within a frame having a barrier plate extending upward to form a lower edge of the passageway. The method includes:

making a notch within the barrier plate along the lower edge of the passageway;

attaching a carrier bracket to the sliding door, mounting a compression panel on the carrier bracket to be movable toward the barrier plate and away from the barrier plate;

mounting a compressible gasket to be disposed between the compression panel and the barrier plate to extend adjacent the notch with the sliding door in the closed position; and mounting the actuator adjacent the compression panel with the sliding door in the closed position.

DETAILED DESCRIPTION OF THE INVENTION

Figure 1:
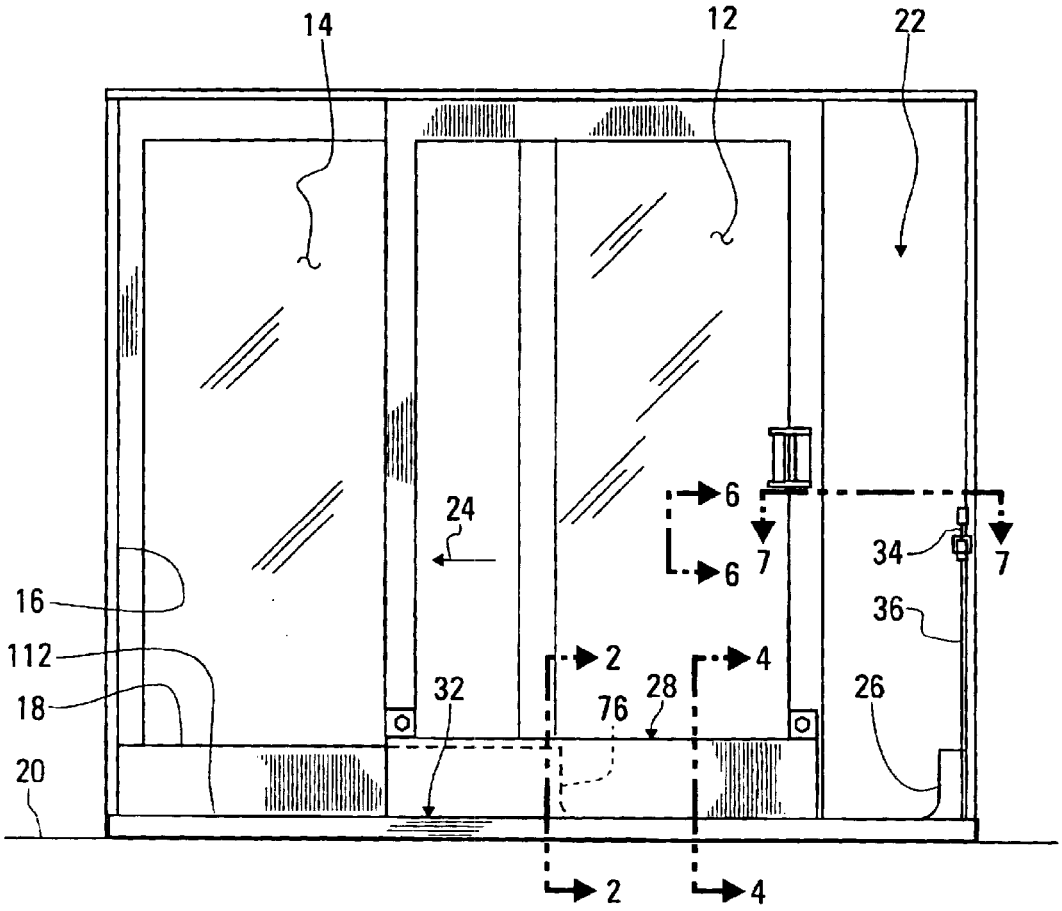
FIG. 1 is front elevation of a door assembly built in accordance with the invention, shown with a sliding door therein partly open.

FIG. 1 is a front elevation of a door assembly 10 built in accordance with the invention, as viewed from inside a structure. The sliding door assembly 10 includes a sliding door 12, shown as partly closed, a stationary door 14, outwardly disposed from the sliding door 12, and a doorframe 16. To provide the various features of the invention, the door assembly 10 additionally includes a barrier plate 18 extending upward from a level of a floor 20 to prevent water penetration. To avoid presenting a tripping hazard to individuals walking through the passageway 22 within the doorframe 16 with the sliding door 12 moved in the direction of arrow 24 into its open position, and further to avoid presenting a barrier to wheelchair access through this passageway 22, the barrier plate 18 includes a notch 26 extending downward to enlarge this passageway 22.

In order to maintain the water sealing function of the barrier plate 18, the notch 26 is sealed by means of a compression panel subassembly 28, attached to the sliding door 12 by bolts 30, to move out of the passageway 22 when the sliding door 12 is opened. The door assembly 10 additionally includes an actuator subassembly 32 extending along the floor 10 adjacent the compression panel subassembly 28. When the sliding door 12 is in its closed position, the actuator subassembly 32 operates in response to movement of a latch lever 34 connected to the actuator subassembly 32 by means of a flexible member 36 to seal the notch 26 to prevent water damage and to release seal on the notch 26 to allow movement of the sliding door 12. While the flexible member is shown as a steel cable, it is understood that the flexible member may alternately be, for example, a flexible plastic strap.

Figure 2:
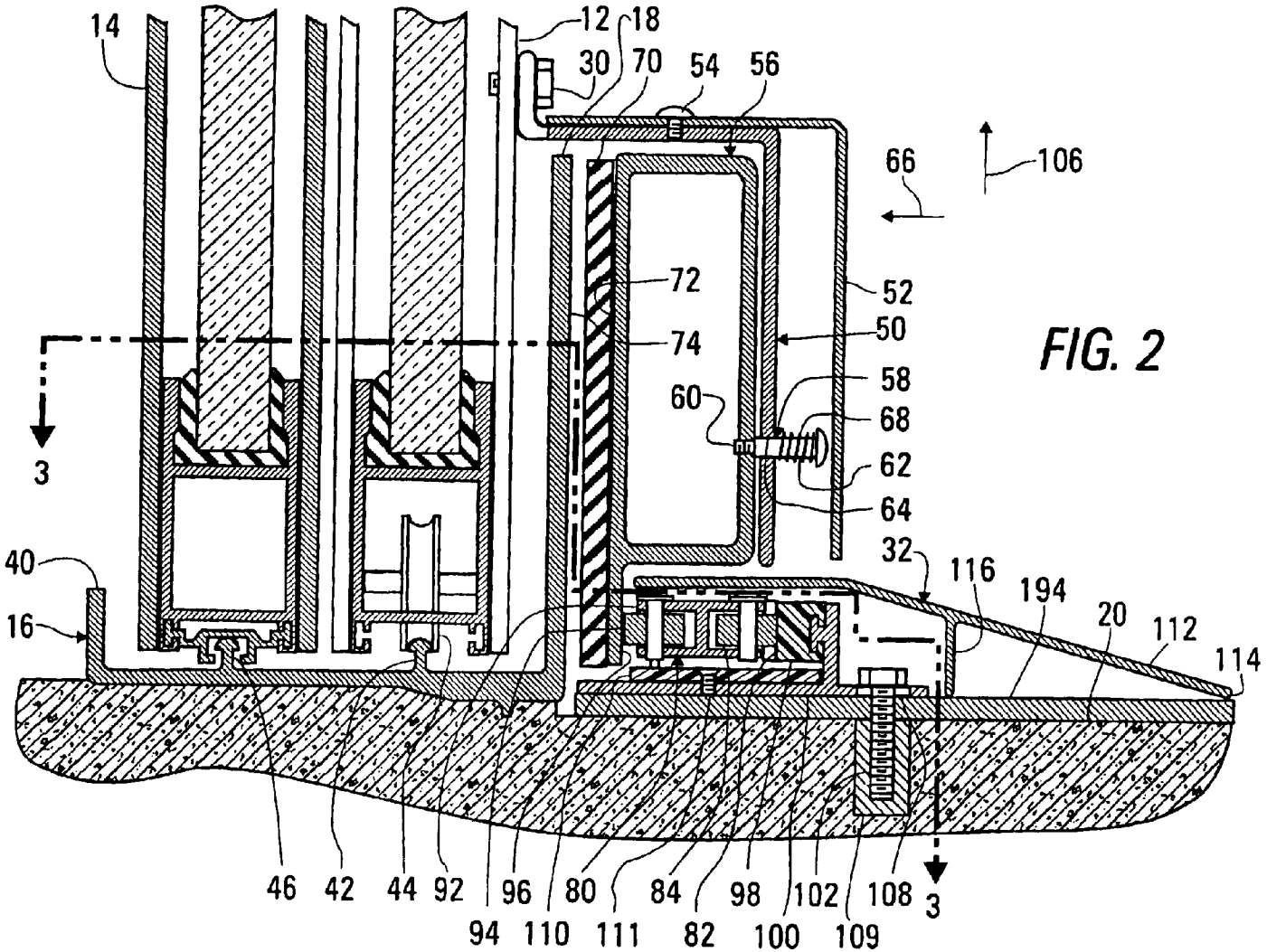
FIG. 2 is a fragmentary cross-sectional elevation of the door assembly of FIG. 1, taken as indicated by section line 2—2 therein to show a compression panel subassembly and an actuator subassembly.

FIG. 2 is a fragmentary cross-sectional elevation of the door assembly 10, taken as indicated by section line 2—2 in FIG. 1. The barrier plate 18 is shown to be an upstanding portion of a threshold frame member 40, which forms a lower portion of the doorframe 16. The sliding door 12 is movably mounted on an inner rail 42 of the threshold frame member 40 by means of a number of rollers 44, while the stationary door 14 rests on an outer rail 46 of the threshold frame member 40.

The compression panel subassembly 28 includes a panel mounting bracket 50 attached to the sliding door 12 by the screws 30, a decorative cover 52 fastened to the panel mounting bracket 50 by means of a number of screws 54, and a compression panel 56 slidably mounted on the panel mounting bracket 50 by means of a number of shoulder screws 58. Each of the shoulder screws 58, which is attached to the compression panel 56 by threads 60, includes a shoulder 62 sliding within a hole 64 in the panel mounting bracket 50. In this way, the compression panel 56 is mounted to move in and opposite the engagement direction of arrow 66, with a number of compression springs 68 pushing the compression panel 56 in the direction opposite arrow 66 through the shoulder screws 58. The upper surface of the compression panel 56 is as high as the upper surface of the barrier plate 18.

Figure 3:
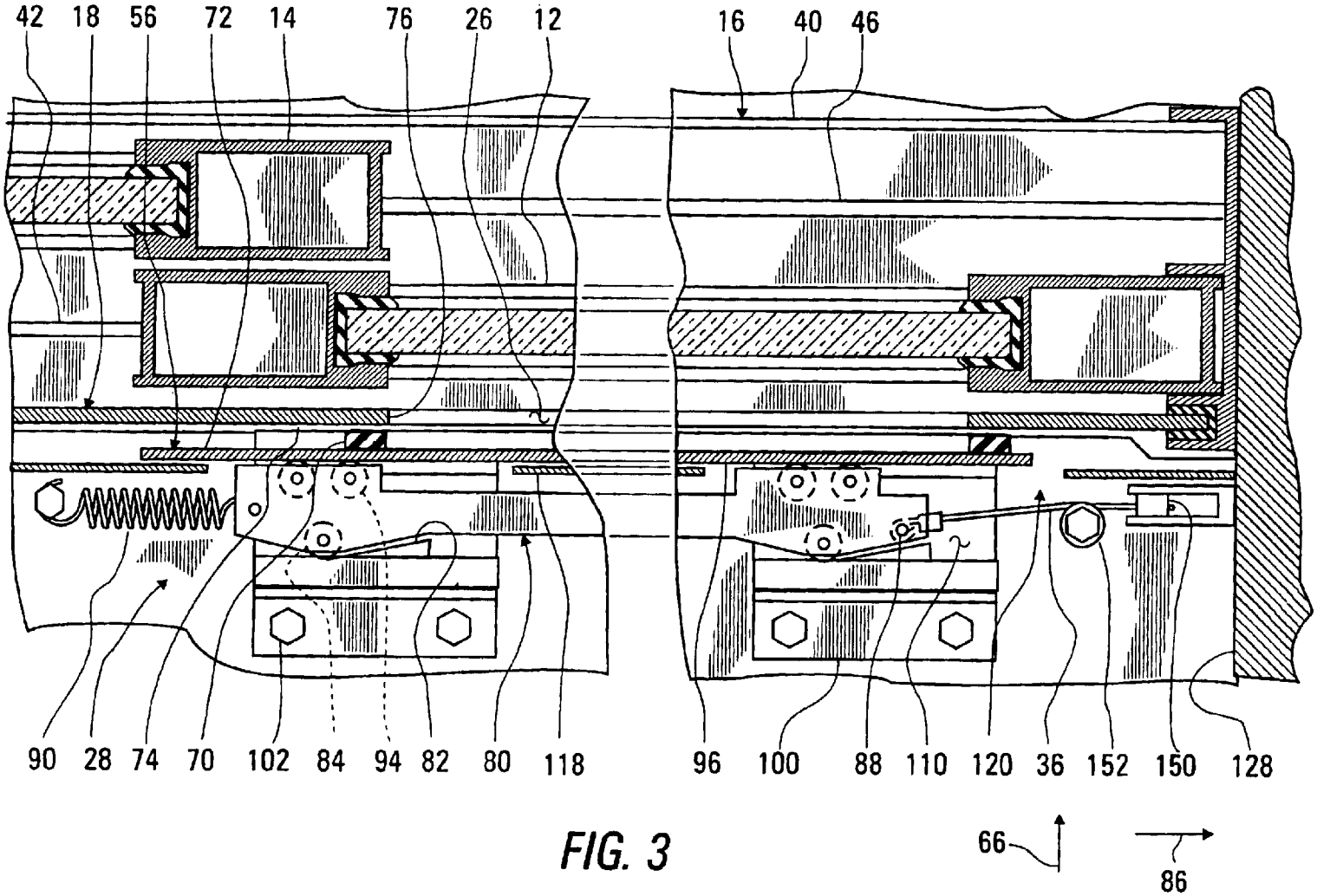
FIG. 3 is a fragmentary cross-sectional plan view of the door assembly of FIG. 1, taken as indicated by section line 3—3 in FIG. 2.

FIG. 3 is a fragmentary cross-sectional plan view of the door assembly 10, taken as indicated by section line 3—3 in FIG. 2. While FIGS. 1 and 2 show the sliding door 12 partly open, FIG. 3 shows the sliding door 12 fully closed. Referring to FIGS. 2 and 3, a compressible gasket 70 is attached to an outer surface 72 of the compression panel 56. The compressible gasket 70 extends adjacent the notch 26 in the barrier plate 18, so that, when the compression panel 56 is driven in the engagement direction of arrow 66, the compressible gasket 70 is compressed between the outer surface 72 of the compression panel 56 and the inner surface 74 of the barrier plate 18 within an area extending adjacent the notch 26. Both FIGS. 2 and 3 are cross-sectional views taken through a vertically extending portion of the gasket 70 adjacent an end 76 of the notch 26.

The actuator subassembly 32 includes an actuator 80 rolling along a pair of inclined surfaces 82 by means of rollers 84. The actuator 80 is pulled to the right, in the direction of arrow 86, by means of the flexible member 36 attached to the actuator 80 by a pin 88, which is in turn pulled by the latch lever 34 (shown in FIG. 1). As the latch lever 34 is moved to allow movement of the actuator 80 opposite the direction of arrow 86, the actuator is returned to the left by a force applied by an actuator spring 90. The actuator 80 is an elongated member to which the rollers 84 and 94 are rotatably attached. The rollers 94 roll against an adjacent surface 96 of the compression panel 56. The inclined surfaces 82 extend along stationary ramps 98 attached to ramp brackets 100. The ramp brackets 100 are in turn fastened to the underlying floor by means of self-threading concrete fasteners 102. A shim 104 is used to align the actuator subassembly 32 with the compression panel 56 in the vertical direction of arrow 106. Each of the ramp brackets 100 additionally includes a plastic bearing plate 110, fastened to the bracket 100 by means of screws 111, to provide a surface along which the actuator 80 slides.

Figure 4:
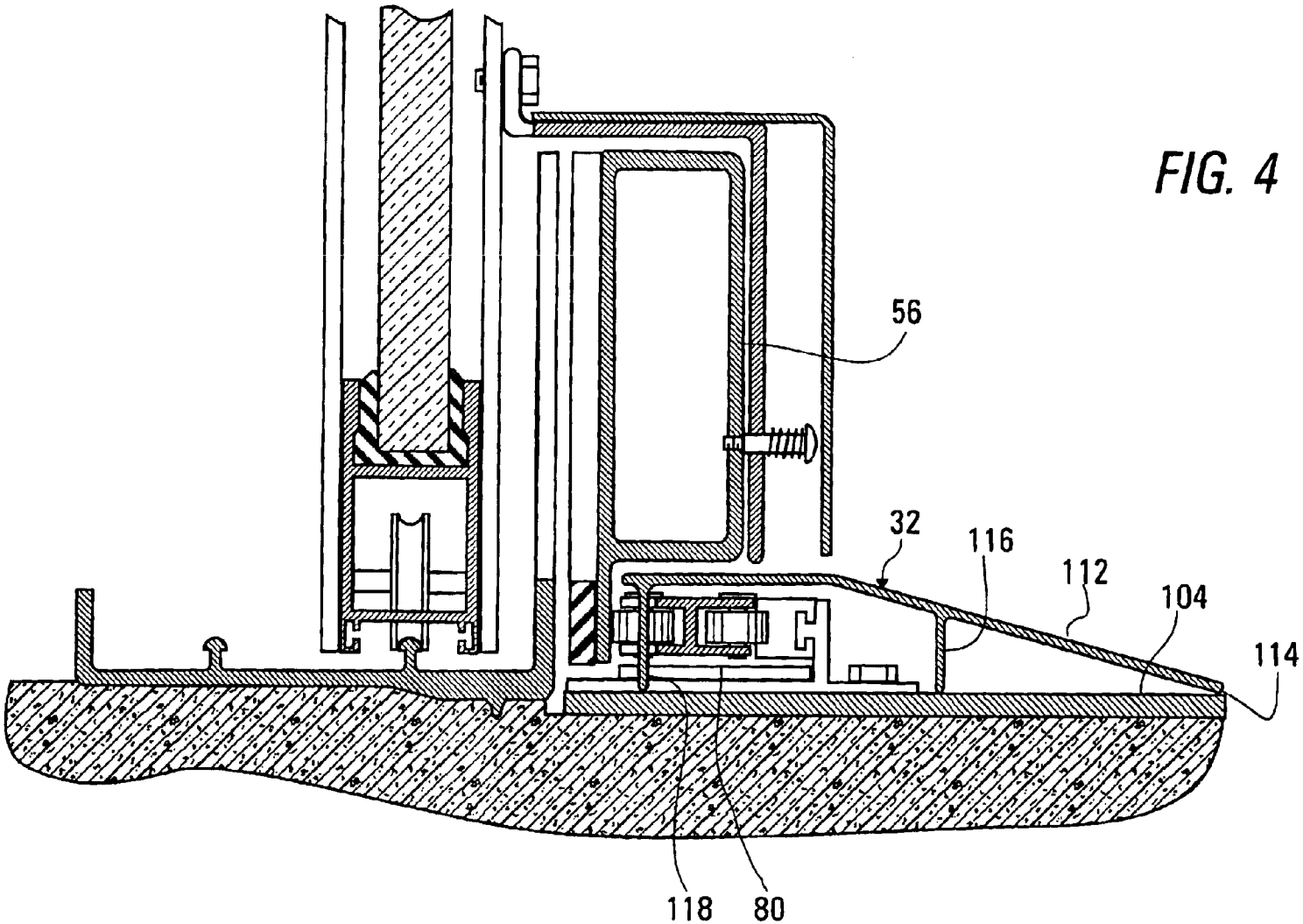
FIG. 4 is a fragmentary cross-sectional elevation of the door assembly of FIG. 1, taken as indicated by section-line 4—4 therein, showing a sliding door therein in a closed position.
Figure 5:
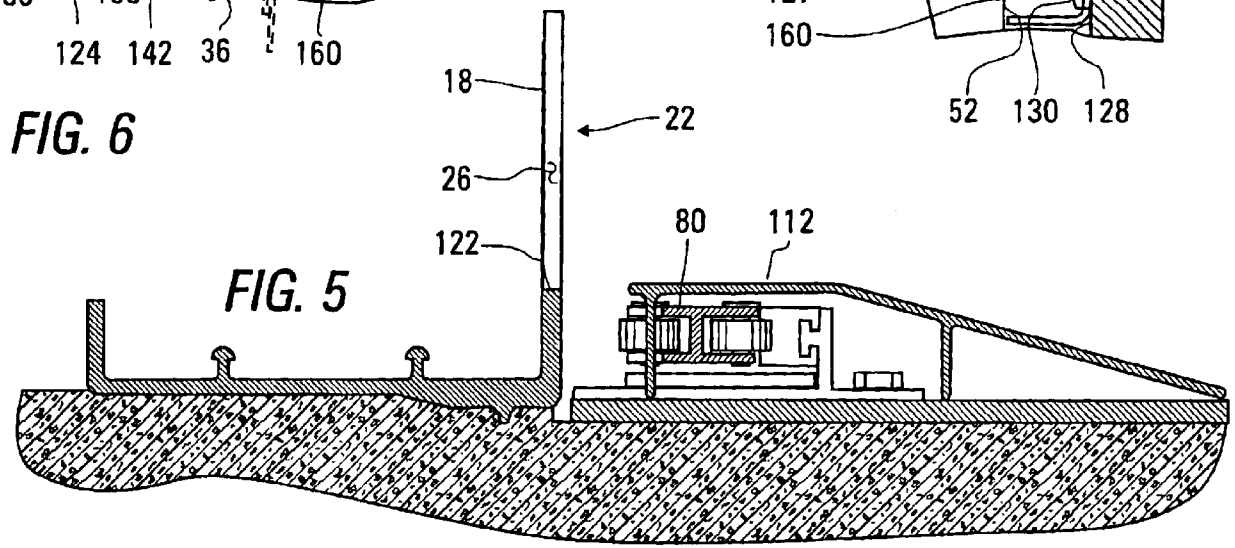
FIG. 5 is a fragmentary cross-sectional elevation of the door assembly of FIG. 1, taken as indicated by section-line 5—5 therein, showing a passageway formed by opening the sliding door therein.

FIGS. 4 and 5 are fragmentary cross-sectional elevations of the door assembly 10, taken as indicated by section line 44 in FIG. 1, with FIG. 4 showing the sliding door 12 in its closed position, and with FIG. 5 showing the passageway 22 provided by opening the sliding door 12.

Referring to FIGS. 2–4, the actuator subassembly 32 additionally includes a threshold cover 112, supported on the surface of the shim 104 by its edge 114 and by downward extending ribs 116, 118, with rib 118 being divided into sections with intervening spaces 120. As additionally shown in FIG. 1, the threshold cover 112 extends adjacent the stationary door 14 as well as the sliding door 13.

Comparing FIG. 5 with FIG. 4, when the sliding door 12 is opened, the compression panel subassembly 28 moves with it, leaving a passageway 22 that is easy to walk through and to roll a wheelchair through, with the highest elements being the threshold cover 112 and the surface 122 forming the bottom of notch 26 in the barrier plate 18. The actuator 80 is protected by the threshold cover 112 from being damaged by traffic moving through the passageway 22.

Figure 7:
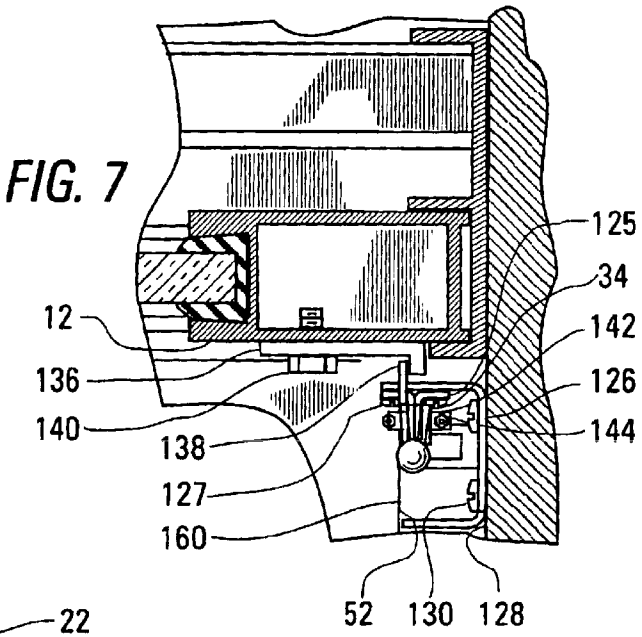
FIG. 7 is a fragmentary cross-sectional plan view of the door assembly of FIG. 1, taken as indicated by section line 7—7 therein.
Figure 6:
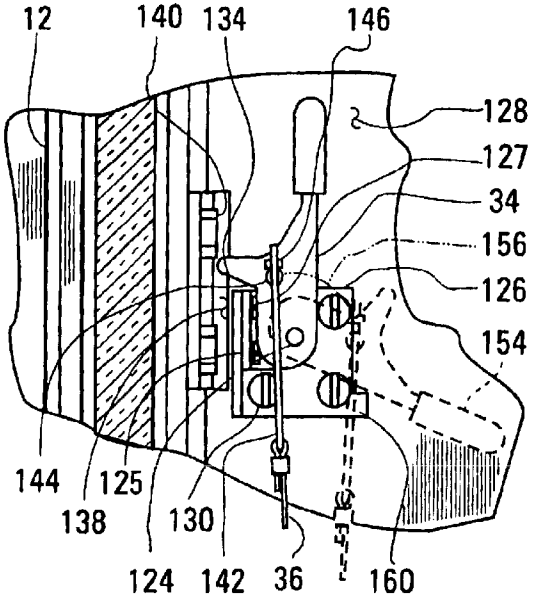
FIG. 6 is a fragmentary cross-sectional elevation of the door assembly of FIG. 1, taken as indicated by section line 6—6 therein to show a latch lever.

The latch lever 34 will now be discussed, with particular reference being made to FIGS. 6 and 7. FIG. 6 is a fragmentary cross-sectional elevation of the door assembly 10, taken as indicated by section line 6—6 in FIG. 1 to shown the latch lever 34 and associated structures, while FIG. 7 is a fragmentary plan view of the door assembly 10, taken as indicated by section line 7—7 in FIG. 1. While FIG. 1 shows the sliding door 12 as partly open, FIGS. 6 and 7 show the door 12 as fully closed.

The latch lever 34 is pivotally mounted by a pin 124 on a pair of brackets 125, which are in turn fastened to a mounting bracket 126 by means of screws 127. The mounting bracket 126 is in turn mounted to a wall 128 by a number of screws 130. In FIGS. 6 and 7, the latch lever 34 is shown as pivoted into its raised position, pulling the actuator in the direction of arrow 86 (shown in FIG. 3) by means of the flexible member 36, so that the gasket 70 is compressed between the pressure panel 56 and the barrier plate 18. Preferably, the latch lever 34 additionally includes a locking pawl 134 that prevents the opening of the sliding door 12 from its closed position when the latch lever 34 is in its raised position. In the example of these figures, a locking plate 136 has been attached to the sliding door 12 to provide a surface 138 to be stopped by the locking pawl 134 if an attempt is made to open the sliding door with the latch lever 34 in its raised position. The locking plate 136 is fastened to the sliding door 112 by a pair of bolts 140.

Referring to FIGS. 3, 6, and 7, the flexible member 36 is fastened to a U-shaped attachment frame 142, which is in turn fastened to the latch lever 36 by means of a pivoting pin 144. The attachment frame 142 extends through a pair of holes within the pin 144, being held in place by a pair of nuts 146 engaging threads along the ends of the frame 142. The flexible member 36 extends downward from the attachment frame 142 and partly around a pair of pulleys 150, 152, to be attached to the actuator 80 by means of the pin 88. The pulleys 150, 152 may be individually fastened to the floor 20, below the shim 104, and to the wall 128, as shown, or they may be fastened to a common bracket (not shown) that is in turn fastened to the floor 20 or to the wall 128.

Starting with the sliding door 12 in its closed position, and with the latch lever 34 in its raised position, the latch lever 34 is lowered into the position indicated in FIG. 6 by dashed lines 154 before the sliding door 12 can be opened. During this process, the locking pawl 134 moves out of the path of surface 138 of the locking plate 136, so that the door 128 can be opened. Also, as the lever 34 is lowered, the pivoting pin 136 moves along an arcuate path 156, so that the upper end of the flexible member 36 moves downward, allowing the actuator spring 30 to move the actuator 80 to the left, opposite the direction of arrow 86. Preferably, the bracket 126 includes a lower motion limiting tab 160 limiting the pivoting motion of the latch lever 34. The resulting movement of the actuator 80 along the inclined surfaces 82 allows the springs 58 (shown in FIG. 2) to move the compression panel 56 opposite the direction of arrow 66, so that the compressible gasket 70 is moved away from the barrier plate 18. Then, the sliding door 21 is opened by sliding to the left.

Preferably, the arcuate path 156 extends on both sides of the pivot pin 124, so that the latch lever 34 acts as a toggle, being held in both raised and lowered portions by a force applied by the actuator spring 90 through the flexible member 36.

While the sliding door 12 remains open, the latch lever 34 is left in its lowered position, as indicated by dashed lines 154. Then, after the sliding door 12 is fully closed, the latch lever 34 is rotated into its raised position, with the flexible member 36 pulling the actuator 80 in the direction of arrow 86. As the rollers 86 are pulled up along the inclined surfaces 82, the actuator 80 is also moved in the direction of arrow 55, so that the gasket 70 is compressed against the barrier plate 18. This movement of the latch lever 34 into its raised position additionally moves the locking pawl 134 into place to prevent the re-opening of the sliding door 12

Figure 9:
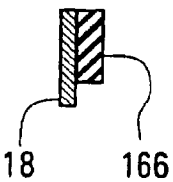
FIG. 9 is a cross sectional view of the barrier plate of FIG. 8, taken as indicated by section line 9—9 therein.
Figure 8:
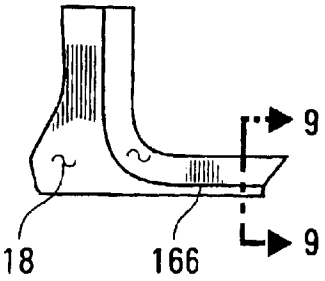
FIG. 8 is a fragmentary elevation of a barrier plate having an alternative compressible gasket for use in the door assembly of FIG. 1.

The preceding discussion has described the compressible gasket 70 as being attached to the an outer surface 72 of the compression panel 56, providing an advantage of moving the gasket 70 out of harm's way with the sliding glass door 12, so that subsequent movement of individuals through the passageway 22 with the sliding door 12 open will not damage the gasket 70. Nevertheless, it is understood that a compressible gasket may alternatively be attached to the barrier plate, as shown in FIGS. 8 and 9. FIG. 8 is a fragmentary elevation of the barrier plate 18, having an elastomeric strip 166 attached thereto, while FIG. 9 is a cross-sectional elevation of this plate 18 and elastomeric strip 166, taken as indicate by section line 9—9 in FIG. 8. The elastomeric strip, which is composed, for example, of a material such as a closed cell neoprene foam, is adhesively attached to the barrier plate 18.

Figure 10:
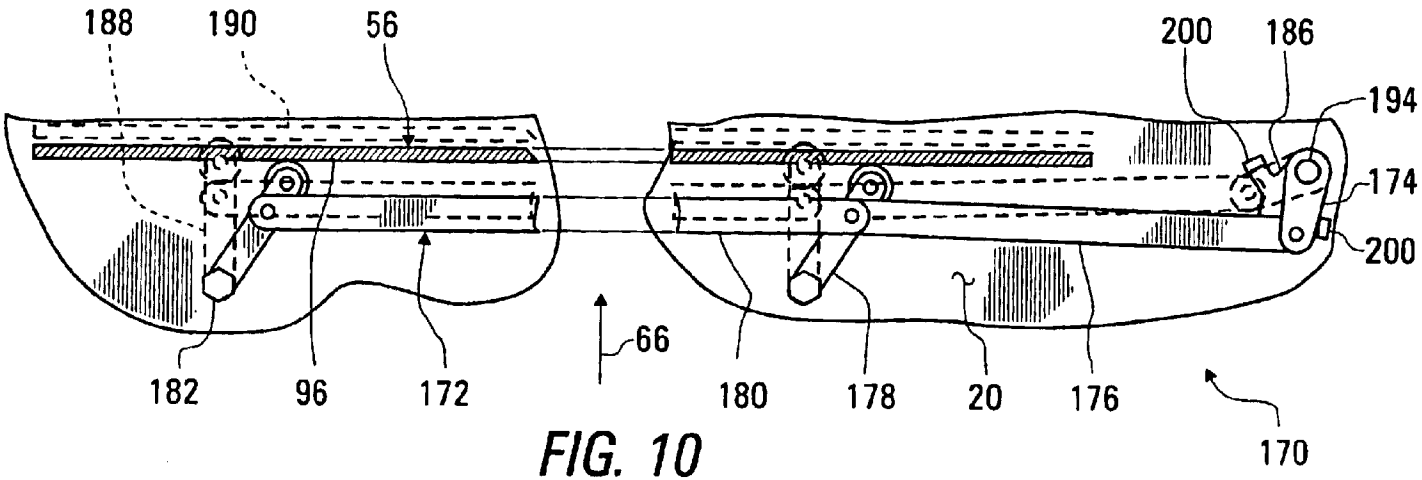
FIG. 10 is a fragmentary plan view of a first alternative actuator for use in the door assembly of FIG. 1.

FIG. 10 is a plan view of an alternative actuator 170, which is composed of a parallelogram linkage 172 driven by a crank 174 through a crank link 176. The parallelogram linkage includes a pair of arms 178 and a connecting link 180. Each of the arms, which is pivotally attached to the floor 20 by means of a shoulder screw 182, includes a rotatably mounted roller 184. As the crank 174 is rotated between the position in which it is shown and the position indicated by dashed lines 186, the linkage 178 moves from the position in which it is shown into the position indicated by dashed lines 188, with the rollers 184 rolling against the adjacent surface 96 of the compression panel 56, so that this portion of the panel 56 is moved in the direction of arrow 66 into the position indicated by dashed lines 190. When the crank 174 is rotated from the position indicated by dashed lines 186 into the position in which it is shown to this process is reversed, with the springs 63, shown in FIG. 2, returning the compression panel 56 from the position indicated by dashed lines 188.

Figure 11:
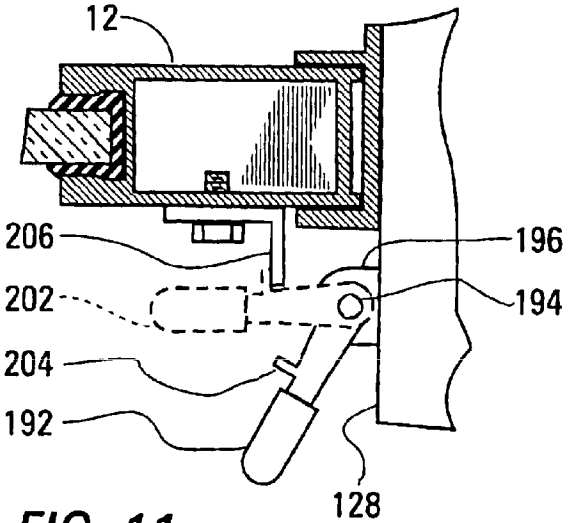
FIG. 11 is a cross-sectional plan view showing an alternative latch lever for use with the first alternative actuator of FIG. 10.

FIG. 11 is a partly sectional plan view showing a cross-section of the sliding door 12, together with a plan view of a latch lever 192 turning the crank 174 by means of a shaft extending downward between the lever 192 and the crank 174, being pivotally mounted in a bearing block 196 attached to the wall 128 and in a bearing plate 198 attached to the floor 20. Preferably, the bearing plate 198 also includes a pair of tabs 200 limiting the rotational movement of the crank 174. As the latch lever 192 moves from the position in which it is shown into the position indicated by dashed lines 202, the crank 174 is moved from the position in which it is shown into the position indicated by dashed lines 186, so that the compressible gasket 70 or 168 is clamped by the clamping plate 56. As the latch lever 192 is then returned to the position in which it is shown, the compressible gasket 70 or 168 is released. Preferably, the latch lever 192 also includes a locking pawl 204, which stops movement of the sliding door 12 from its closed position by contacting a stop plate 206 attached to the door 12 when the latch lever is in the position indicated by dashed lines 202.

Figure 12:
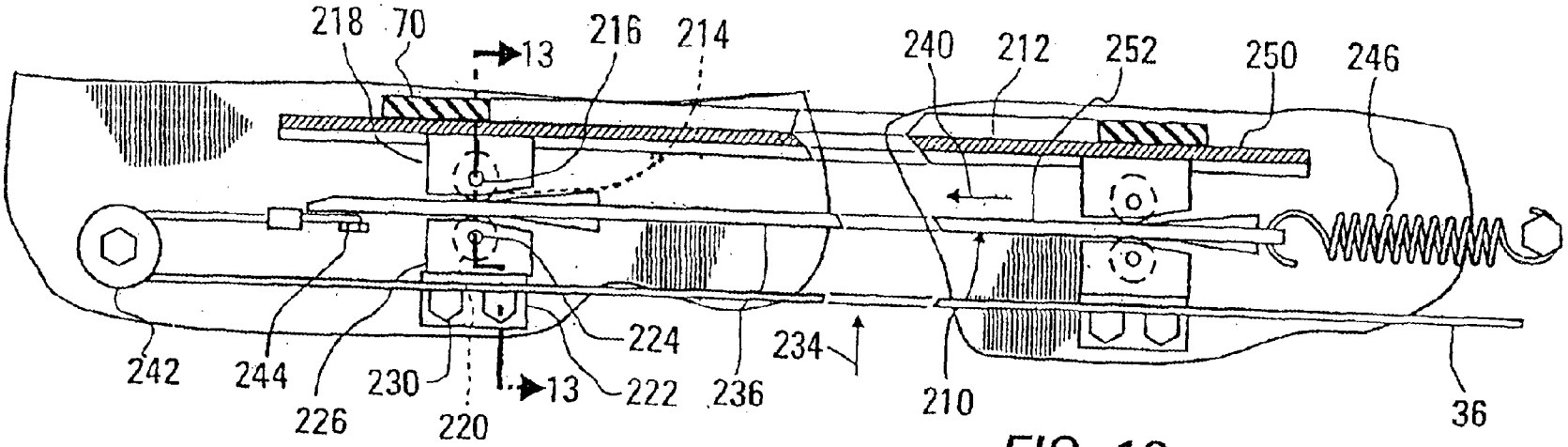
FIG. 12 is a fragmentary plan view of a second alternative actuator for use in the door assembly of FIG. 1.
Figure 13:
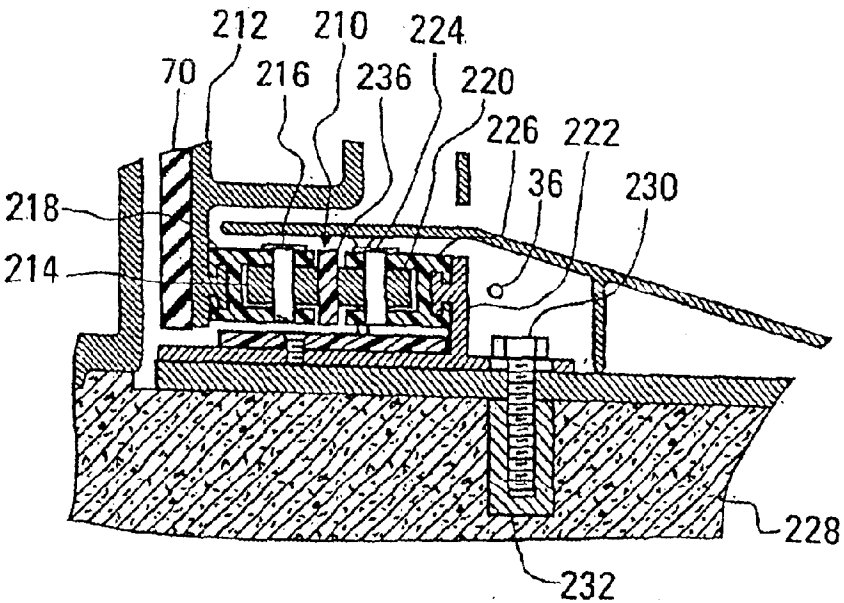
FIG. 13 is a fragmentary cross-sectional elevation of a door assembly including the second alternative actuator of FIG. 12, taken as indicated by section line 13—13 therein.

The use of a second alternative actuator will now be discussed with particular reference to FIGS. 12 and 13. FIG. 12 is a fragmentary plan view of the second alternative actuator 210, along with associated elements of a door assembly, while FIG. 13 is a fragmentary cross-sectional view thereof, taken as indicated by section lines 13—13 in FIG. 12. For use with this actuator 210, a compression panel 212, which is otherwise similar to the compression panel 56 described above in reference to FIGS. 1–4, is provided with a pair of rollers 214, which are rotatably mounted on pins 216 attached within attachment blocks 218 clamped in place on the compression panel 214. Similarly, a pair of rollers 220 is rotatably mounted to stationary brackets 222 by means of pins 224 extending within attachment blocks 226. The attachment blocks 218, 226 may be metal or plastic. The stationary brackets 222 are attached to the floor by means of bolts 230, which may extend into bolt anchors 232, or which may be fastened directly into the floor by means of self-tapping threads. The stationary brackets 222 are disposed so that the rollers 220 are aligned with the rollers 214 in the direction of arrow 234.

The second alternative actuator 210 includes an elongated bar 236 and a pair of ramp structures 238, which are disposed along the actuator 210 to move between the opposing rollers 214 and 220 as the actuator 210 is moved in the engagement direction of arrow 240. The rollers 214 are held in contact with the actuator 210 by means of a number of springs (not shown), which act in the manner of springs 68, described above in reference to FIG. 3. Thus, when the actuator 210 is pulled in the engagement direction of arrow 240 the compression panel 212 moves in the direction of arrow 234. For example, the flexible member 36 is directed around a floor-mounted pulley 242 to be attached to the actuator 210 by means of a screw 244, so that the actuator 210 is moved in the direction of arrow 240 in response to upward movement of the latch lever 34, as described above in reference to FIGS. 6 and 7. This movement of the compression panel 212 in the direction of arrow 234 compresses a compressible gasket 70 in the manner described above in reference to FIGS. 1–4. An actuator spring 246 is provided to maintain tension within the flexible member 36 and to return the actuator 210 in the direction opposite that of arrow 240.

While the ramp structures 238 are shown as extending outward from both sides of the elongated beam 238, it is understood that these structures 238 may alternately extend outward only from one of these sides, in the direction of arrow 234 or opposite thereto.

It is additionally understood that the alternative actuator 170 may otherwise be moved by the flexible member 36 and by the actuator spring 90, generally as described in reference to FIG. 3, and that the actuator 80 may alternately be moved by a linkage in the manner generally described in reference to FIGS. 10 and 11.

The invention may be applied at a doorway of a building during the construction of the building. Alternately, the invention may be applied at an existing doorway after the construction of the building by cutting the notch 26 in the existing barrier plate and by fastening the various components of the invention in place as described on the floor, wall, and the sliding door.

While the invention has been described in its preferred versions with some degree of particularity, it is understood that this description has been given only by way of example, and that numerous changes in the configuration and combination of parts may be made without departing from the spirit and scope of the invention, as defined in the appended claims.

What is claimed is:

1. Apparatus for creating and sealing an unobstructed opening across a lower portion of a passageway covered by a sliding door movable between open and closed positions comprising a barrier plate having a notch adapted to extend across the lower portion of the passageway, wherein said apparatus further comprises:

a compression panel, a carrier bracket attached to the sliding door, wherein said compression panel is mounted on said carrier bracket to be moved with the sliding door and to be movable toward said barrier plate and away from said barrier plate;

a compressible gasket, adapted to be disposed between said compression panel and said barrier plate to extend adjacent said notch when the sliding door is in the closed position; and an actuator, disposed adjacent said compression panel when the sliding door is in the closed position, mounted to move between a disengaged position and an engaged position, wherein movement of said actuator into said engaged position when the sliding door is in the closed position causes said compression panel to be moved in contact with said actuator toward said barrier plate, compressing said compressible gasket between said compression panel and said barrier plate, and wherein movement of said actuator into said disengaged position when the sliding door is in the closed position allows movement of said compression panel in contact with said actuator away from said barrier plate, releasing compression of said compressible gasket between said compression panel and said barrier plate.

2. The apparatus of claim 1, wherein said actuator includes an elongated member extending adjacent said compression panel when the sliding door is in the closed position, said apparatus additionally includes stationary ramps disposed adjacent opposite ends of said elongated member, said actuator moves along said stationary ramps between said disengaged position and said engaged position, and said stationary ramps are inclined to move said actuator toward said barrier plate in contact with said compression panel when the sliding door is in the closed position as said actuator is moved into said engaged position.

3. The apparatus of claim 2, wherein said actuator additionally includes:

a first pair of rollers rotatably mounted on said elongated member to roll in contact with said stationary ramps; and a second pair of rollers rotatably mounted on said elongated member to roll in contact with said compression panel.

4. The apparatus of claim 1, wherein said apparatus includes a first pair of spaced apart rollers mounted to rotate about stationary axes, said compression panel includes a second pair of rotatably mounted rollers, each of said rollers in said second pair of rollers is aligned with a roller in said first pair of rollers when the sliding door is in the closed position, said actuator includes an elongated member extending between said first and second pairs of rollers when the sliding door is in the closed position, and said elongated member includes a pair of ramp portions moving between said first and second pairs of rollers when the sliding door is in the closed position and to move said compression panel toward said barrier plate as said actuator is moved into said engaged position.

5. The apparatus of claim 1, additionally comprising:

a latch lever adapted to be pivotally mounted adjacent the passageway covered by the sliding door;

a flexible member extending between said latch lever and said actuator to move said actuator between said disengaged position and said engaged position with rotation of said latch lever; and an actuator spring, attached to said actuator, maintaining tension within said flexible member.

6. The apparatus of claim 5, wherein said latch lever includes a locking pawl movable into a position preventing movement of the sliding door from the closed position as said latch lever is moved to move said actuator into said engaged position.

7. The apparatus of claim 1, wherein said compressible gasket is attached to a surface of said compression panel adjacent said barrier plate.

8. The apparatus of claim 1, wherein said compressible gasket is attached to said barrier plate.

9. The apparatus of claim 1, additionally comprising at least one spring extending between said compression panel and said carrier bracket to move said compressible gasket away from said upstanding leg of said barrier plate.

10. The apparatus of claim 1, wherein said actuator is adapted to extend inwardly adjacent the sliding door, and said apparatus additionally comprises a stationary cover extending over said actuator.

11. The apparatus of claim 1, wherein said actuator includes:

a pair of arms pivotally mounted on stationary pivots;

a connecting link pivotally mounted on each of said arms to extend between said arms, and a pair of rollers mounted to roll in contact with said compression panel when the sliding door is in the closed position, moving said compression panel toward said barrier plate as said actuator is moved into said engaged position.

12. Door apparatus including:

a sliding door;

a frame mounting the sliding door to move between open and closed positions, wherein the frame includes a barrier plate having a notch forming a part of a passageway covered by the sliding door in the closed position;

a compression panel;

a carrier bracket attached to the sliding door, wherein the compression panel is mounted within the carrier bracket to be moved with the sliding door and to be movable toward the barrier plate and away from the barrier plate;

a compressible gasket disposed between the compression panel and the barrier plate to extend adjacent the notch with the sliding door in the closed position; and an actuator, disposed adjacent the compression panel with the sliding door in the closed position, mounted to move between a disengaged position and an engaged position, wherein movement of the actuator into the engaged position with the sliding door in the closed position causes the compression panel to be moved in contact with the actuator toward the barrier plate, compressing the compressible gasket between the compression panel and the barrier plate, and wherein movement of the actuator into the disengaged position with the sliding door in the closed position allows movement of the compression panel in contact with the actuator away from the barrier plate, releasing compression of the compressible gasket between the compression panel and the barrier plate.

13. The door apparatus of claim 12, wherein said actuator includes an elongated member extending adjacent said compression panel with said sliding door in said closed position, said apparatus additionally includes stationary ramps disposed adjacent opposite ends of the elongated member, said actuator moves along the stationary ramps between said disengaged position and said engaged position, and the stationary ramps are inclined to move said actuator toward said barrier plate in contact with said compression panel with said sliding door in said closed position as said actuator is moved into said engaged position.

14. The door apparatus of claim 12, wherein said apparatus includes a first pair of spaced apart rollers mounted to rotate about stationary axes, said compression panel includes a second pair of rotatably mounted rollers, each of said rollers in said second pair of rollers is aligned with a roller in said first pair of rollers with said sliding door in said closed position, said actuator includes an elongated member extending between said first and second pairs of rollers with said sliding door in said closed position, and said elongated member includes a pair of ramp portions moving between said first and second pairs of rollers with said sliding door in said closed position to move said compression panel toward said barrier plate as said actuator is moved into said engaged position.

15. The door apparatus of claim 12, additionally comprising:

a latch lever pivotally mounted adjacent said passageway covered by said sliding door;

a flexible member extending between the latch lever and said actuator to move said actuator between said disengaged position and said engaged position with rotation of the latch lever; and an actuator spring, attached to said actuator, maintaining tension within the flexible member.

16. The apparatus of claim 15, wherein said latch lever includes a locking pawl moving into a position preventing movement of said sliding door from said closed position as said latch lever is moved to move said actuator into said engaged position.

17. The apparatus of claim 12, additionally comprising at least one spring extending between said compression panel and said carrier bracket to move said compressible gasket away from said upstanding leg of said barrier plate.

18. The apparatus of claim 12, wherein said actuator extends inwardly adjacent said sliding door, and said apparatus additionally comprises a stationary cover extending over said actuator.

19. A method for enlarging a passageway covered by a door sliding within a frame having a barrier plate extending upward to form a lower edge of the passageway, wherein the method comprises:

cutting a notch within the barrier plate along the lower edge of the passageway;

attaching a carrier bracket to the sliding door, mounting a compression panel on the carrier bracket to be moved with the sliding door and to be movable toward the barrier plate and away from the barrier plate;

mounting a compressible gasket to be disposed between the compression panel and the barrier plate to extend adjacent the notch with the sliding door in the closed position; and mounting an actuator adjacent the compression panel with the sliding door in the closed position, to move along a stationary surface between a disengaged position and an engaged position, wherein movement of the actuator into the engaged position with the sliding door in the closed position causes the compression panel to be moved in contact with the actuator toward the barrier plate, compressing the compressible gasket between the compression panel and the barrier plate, and wherein movement of the actuator into the disengaged position with the sliding door in the closed position allows movement of the compression panel in contact with the actuator away from the barrier plate, releasing compression of the compressible gasket between the compression panel and the barrier plate.

20. The method of claim 19, wherein said actuator includes an elongated member extending adjacent said compression panel with said sliding door in said closed position, and mounting said actuator to move along a stationary surface includes attaching a pair of stationary ramps adjacent opposite ends of the elongated member so that the stationary ramps are inclined to move said actuator toward said barrier plate in contact with said compression panel with said sliding door in said closed position as said actuator is moved into said engaged position.

21. The method of claim 20, wherein said apparatus includes a first pair of spaced apart rollers mounted to rotate about stationary axes, said compression panel includes a second pair of rotatably mounted rollers, each of said rollers in said second pair of rollers is aligned with a roller in said first pair of rollers with said sliding door in said closed position, said actuator includes an elongated member extending between said first and second pairs of rollers with said sliding door in said closed position, and said elongated member includes a pair of ramp portions moving between said first and second pairs of rollers with said sliding door in said closed position to move said compression panel toward said barrier plate as said actuator is moved into said engaged position.

22. The method of claim 19, additionally comprising:

pivotally mounting a latch lever adjacent said passageway covered by said sliding door;

attaching a flexible member to extend between the latch lever and said actuator to move said actuator between said disengaged position and said engaged position with rotation of the latch lever; and attaching an actuator spring to extend between a stationary surface and said actuator to maintain tension within the flexible member.

* * * * *